United States Patent [19]

Kvinge et al.

[11] Patent Number: 4,792,291

[45] Date of Patent: Dec. 20, 1988

[54] VISCOUS DAMPED VALVE FOR HYDRAULIC PUMP

[75] Inventors: Daniel J. Kvinge, St. Louis Park; Frederick A. Powers, Maple Grove, both of Minn.

[73] Assignee: Graco Inc., Minneapolis, Minn.

[21] Appl. No.: 94,682

[22] Filed: Sep. 9, 1987

[51] Int. Cl.[4] ..... F04B 17/00; F01L 31/02

[52] U.S. Cl. ..... 417/404; 91/346

[58] Field of Search ..... 417/404, 403, 401, 393; 91/346, 50; 251/48, 50, 75

[56] References Cited

U.S. PATENT DOCUMENTS 2,119,736 6/1938 Coberly ..... 417/404

2,771,907 11/1956 Joy ..... 251/50

*Primary Examiner*—Leonard E. Smith

*Assistant Examiner*—Leonard P. Walnoha

*Attorney, Agent, or Firm*—Douglas B. Farrow

[57] ABSTRACT

The hydraulically powered fluid pump has a spool valve which controls the direction of travel of the pump. The spool valve is designed to switch between positions relatively slowly so that in between pump cycles, the ball checks associated with the pump may return under the force of gravity to their seats. This natural gravity return produces greatly decreased noise levels and increased seat life compared with the slamming action present in current pumps. The spool valve is viscous damped and of a closed centered construction to allow the relatively slow switchover to take place.

1 Claim, 1 Drawing Sheet

VISCOUS DAMPED VALVE FOR HYDRAULIC PUMP

BACKGROUND OF THE INVENTION

Hydraulically powered fluid pumps have proven increasingly popular in recent years. One drawback associated with such pumps has been the substantial noise level associated with them, particularly in an era of increasingly strict noise standards. As part of this invention, it has been found that the noise in large part is caused by the slamming of the ball checks onto their seats It is therefore an object of this invention to provide a fluid pump which is substantially quieter in operation than the existing prior art pumps and which exhibits reliable operation and decreased maintenance. It is further an object of this invention to provide such a pump which is easily manufactured. It is yet another object of this invention to provide a hydraulically powered fluid pump which changes over reliably under all operating conditions.

SUMMARY OF THE INVENTION

A spool valve is provided for use with a hydraulically powered fluid pump. The spool valve controls the fluid direction to the motor of the fluid pump. In particular, the spool valve is designed to reliably yet relatively slowly change over so as to allow the ball checks in the pump to close naturally under the influence of gravity, rather than be slammed shut by a quick fluid changeover onto their seats. By doing so, noise is greatly reduced and the ball check life is extended along with a reduction of pressure spikes in the outlet pressure.

The spool valve is a relatively standard detented closed centered design. A trip rod activated by the piston in the motor side of the pump causes the spool valve to shift back and forth when the piston has reached approximately the limits of its travel. This general configuration is well known in the prior art. The spool is located in the two positions by means of spring-loaded detents. Springs are provided on both sides of the spool over the trip rod so as to allow force to build up as the spring is compressed until that force exceeds the force required to push the spool past the detent. Because the spool valve is a closed centered design, flow is stopped during the passage from one position to another, thereby assisting and allowing the ball checks to settle naturally. In addition, the orifice in the center of the spool where the trip rod passes through is sized so as to allow the spool to move at the desired rate; that is, the orifice is restricted enough so as to provide a viscous damping action on the spool during changeover.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

It is contemplated that various changes and modifications may be made to the viscous damped valve without departing from the spirit and scope of the invention as defined by the following claims.

Conventional wisdom in the art has it that quick changeover is absolutely necessary for a reliably running pump which will not stall under certain conditions. It has been discovered that such quick changeover greatly exacerbates the noise problem and that the noise problem can be solved by slowing the changeover while at the same time maintaining a reliable operation.

Figure 1:
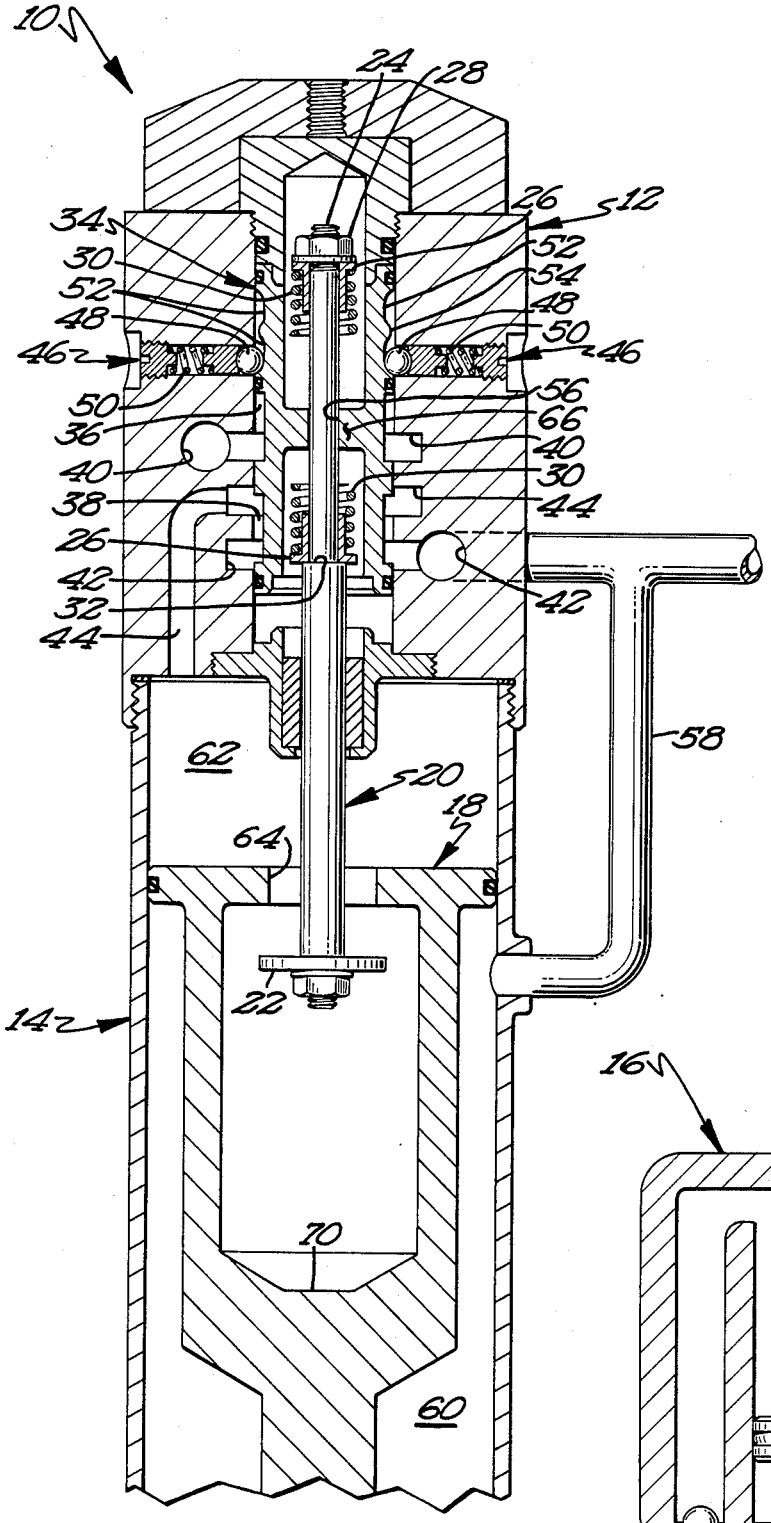
FIG. 1 is a cross-sectional view showing the spool valve from the instant invention.
Figure 2:
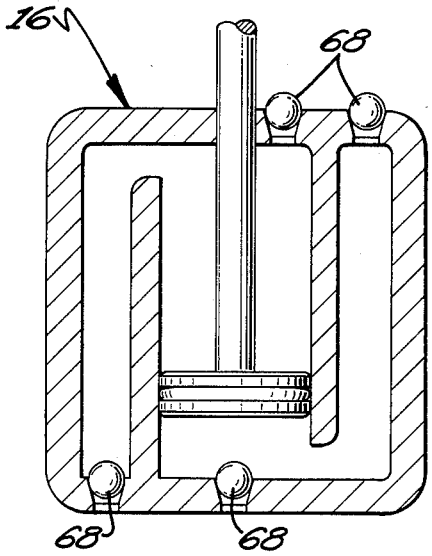
FIG. 2 shows a cross-section of a pump with ball checks.

The instant invention, generally designated 10, is shown in the most detail in FIG. 1. Pump 10 is comprised of a valve unit 12 associated with a hydraulically powered fluid pump which is comprised of a fluid motor 14 and a pump 16. Motor 14 has located therein a piston 18 and a trip rod 20 which has at its lower end thereof a trip plate 22. This general construction is well known in the art and will not be described in any detail except where appropriate.

Trip rod 20 has at its upper end 24, a collar 26 retained by retaining nut 28. Collar 26 helps locate shift spring 30. A shoulder 32 on the mid portion of trip rod 20 helps locate the other retainer 26 and its associated spring 30 as well. Springs 30 alternately contact the center 66 of spool member 34.

Spool 34 has an outlet annular passage 36 formed about its circumference as well as an inlet annular passage 38 similarly formed. An outlet 40 for oil from motor 14 may selectively communicate with passag 36 while similarly inlet 42 f.rom a source of pressurized oil selectively communicates with inlet passage 38. Motor oil passage 44 alternatively communicates with passages 36 and 38 depending on how spool 34 is shifted. As shown in FIG. 1, the motor oil passage 44 is connected with pressurized fluid inlet 42.

Detent assemblies 46 are comprised of a ball 48 which is maintained against spool 34 by a spring 50. Spool 34 has two detent lands 52 which are separated by a detent ridge 54.

In operation, as shown in FIG. 1, piston 18 is in the midst of its downward stroke. Oil from the area 60 beneath piston 18 passes outwardly through passage 58 and along with other oil supplied through the source of pressurized oil 42 passes across passageway 38 of spool 34 into the passageway 44 which leads to the area 62 above piston 18. Because of the difference in areas between the upper side of piston 18 and the lower side of piston 18, the difference in areas times the pressure of the oil results in a net downward force on piston 18.

As piston 18 moves downwardly, the area adjacent to aperture 64 in piston 18 through which trip rod 20 passes strikes the trip plate 22 on trip rod 20, thereby starting the movement of trip rod 20 downwardly. Initially, the bottom end of the upper spring 30 will contact the area 66 adjacent aperature 56 in the center of spool 34. Initially, spool 34 will not move due to the force exerted by detent mechanisms 46. Once piston 18 has moved sufficiently so as to draw trip rod 20 downwardly a sufficient distance, the force built up in spring 30 is sufficient to push spool 34 across the detents. This action is slowed by the damping action caused by the relatively slow movement of the oil between aperture 56 and trip rod 20 between the two chambers and spool 34. Because of the viscous damping of spool 34 and because of the closed center design of spool 34, the piston 18 stays still for a moment, thereby allowing ball checks 68 to close naturally rather than being slammed shut due to a sudden reversal of flow.

After spool 34 has shifted, passageway 36 connects passages 40 and 44. Thence, the pressurized oil is fed through passage 58 into the area 60 beneath piston 18, which thence moves upwardly. Oil from the area 62 above piston 18 is thence formed outwardly through passages 44, 36 and 40 to the oil reservoir or the like. This continues until the interior portion 70 of piston 18 hits the lower end 22 of trip rod 20, reversing the spool through the same process described above to the position shown in FIG. 1.

What is claimed is:

1. In a hydraulic piston pump having a motor and gravity biased ball checks to control the flow of fluid in and out of the pump, and a spool valve for controlling flow or hydraulic fluid to said motor of the pump, the improvement comprising means for delaying the switchover of aid spool valve for a period of time sufficient to allow said ball checks to seat under the force of gravity only said spool valve being viscous damped and closed centered and comprising:

a trip rod;

a spool slideably mounted over said trip rod and having first and second chambers separated by a wall having an orifice trough which said trip rod passes, said orifice being sized so as to allow shifting of said spool at a rate sufficient to allow said ball checks to close under the influence of gravity;

detent means for locating said spool in either first or second positions; and at least one spring mounted between said trip rod and said wall so as to absorb the impact of said trip rod relative to said spool and to store energy in said spring to assist in the shifting of said spool past said detent means.

* * * * *